US010916848B2

(12) United States Patent
Shinkawa

(10) Patent No.: US 10,916,848 B2
(45) Date of Patent: Feb. 9, 2021

(54) ANTENNA

(71) Applicant: YAMAHA CORPORATION, Hamamatsu (JP)

(72) Inventor: Tomohiro Shinkawa, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/135,518

(22) Filed: Sep. 19, 2018

(65) Prior Publication Data

US 2019/0044233 A1 Feb. 7, 2019

Related U.S. Application Data

(63) Continuation of application No. PCT/JP2017/010646, filed on Mar. 16, 2017.

(30) Foreign Application Priority Data

Mar. 22, 2016 (JP) ..... 2016-057137

(51) Int. Cl.
*H01Q 5/378* (2015.01)
*H01Q 5/321* (2015.01)
(Continued)

(52) U.S. Cl.
CPC ..... *H01Q 5/378* (2015.01); *H01Q 5/321* (2015.01); *H01Q 5/385* (2015.01); *H01Q 7/00* (2013.01);
(Continued)

(58) Field of Classification Search
CPC .. H01Q 1/38; H01Q 1/48; H01Q 5/30–5/385; H01Q 9/42
See application file for complete search history.

(56) References Cited

U.S. PATENT DOCUMENTS 7,079,079 B2 * 7/2006 Jo ..... H01Q 1/243 343/700 MS
7,358,906 B2 4/2008 Sato et al.
(Continued)

FOREIGN PATENT DOCUMENTS

JP 2005079969 A 3/2005
JP 2005203878 A 7/2005
(Continued)

OTHER PUBLICATIONS

International Search Report issued in Intl. Appln. No. PCT/JP2017/010646 dated May 30, 2017. English translation provided.
(Continued)

*Primary Examiner* — Hasan Z Islam
(74) *Attorney, Agent, or Firm* — Rossi, Kimms & McDowell LLP

(57) ABSTRACT

Provided is a lower-profile multi-band antenna. According to one embodiment of the present invention, there is provided an antenna including a linear first antenna portion, a conductive portion that connects the first antenna portion with a power feeding point, grounding regions where opposite ends of the first antenna portion are short-circuited and grounded, and a second antenna portion, at least a part of which overlaps with the conductive portion with a dielectric substance interposed between the conductive portion and the second antenna portion. The second antenna portion is disposed in a region surrounded by the grounding regions and the first antenna portion. The conductive portion may be connected to the first antenna portion at a middle point between the opposite ends of the first antenna portion.

5 Claims, 10 Drawing Sheets

(51) Int. Cl.

| | |
|---|---|
| ***H01Q 13/10*** | (2006.01) |
| ***H01Q 7/00*** | (2006.01) |
| ***H01Q 5/385*** | (2015.01) |
| *H01Q 1/38* | (2006.01) |
| *H01Q 9/42* | (2006.01) |
| *H01Q 1/48* | (2006.01) |

(52) U.S. Cl.
CPC ..... *H01Q 13/10* (2013.01); *H01Q 1/38* (2013.01); *H01Q 1/48* (2013.01); *H01Q 9/42* (2013.01)

(56) References Cited

U.S. PATENT DOCUMENTS

| | | | | |
|---|---|---|---|---|
| 9,379,440 | B2 | 6/2016 | Onaka et al. | |
| 9,882,283 | B2 | 1/2018 | Kawata | |
| 2004/0108957 | A1* | 6/2004 | Umehara | H01Q 1/243 343/700 MS |
| 2005/0057400 | A1 | 3/2005 | Yuanzhu | |
| 2012/0287009 | A1* | 11/2012 | Tu | H01Q 1/243 343/845 |
| 2014/0002310 | A1* | 1/2014 | Kim | H01Q 1/2283 343/700 MS |

FOREIGN PATENT DOCUMENTS

| | | | |
|---|---|---|---|
| JP | 2014017806 | A | 1/2014 |
| JP | 2014042142 | A | 3/2014 |
| WO | 2013077302 | A1 | 5/2013 |

OTHER PUBLICATIONS

Written Opinion issued in Intl. Appln. No. PCT/JP2017/010646 dated May 30, 2017.
Office Action issued in Chinese Application No. 201780017452.2 dated Apr. 1, 2020. English translation provided.

* cited by examiner

ANTENNA

CROSS REFERENCE TO RELATED APPLICATION(S)

This application is a continuation of International Patent Application No. PCT/JP2017/010646 filed on Mar. 16, 2017, which claims the benefit of priority of Japanese Patent Application No. 2016-057137 filed on Mar. 22, 2016, the contents of which are incorporated herein by reference in its entirety.

BACKGROUND OF THE INVENTION

1. Field of the Invention

The present invention relates to an antenna. In particular, the present invention relates to a low profile antenna having excellent characteristics that resonates in multiple frequency bands.

2. Description of the Related Art

In the related art, in order to provide a so-called dual band antenna corresponding to two frequencies, there is disclosed an antenna including: a radiation conductor that is disposed on a ground (GND); and an element that is disposed in proximity to the radiation conductor and is short-circuited to the parasitic ground (for example, JP-A-2005-79969 as Patent Literature 1).

Patent Literature 1: JP-A-2005-79969

However, with the radiation conductor disposed on the ground and the element disposed in proximity to the radiation conductor and short-circuited to the parasitic ground, a corresponding distance becomes necessary in order to adjust a characteristic impedance and there is a limit on reduction in height (reduction in thickness).

The present invention has been made in order to solve the above-described problems of the related art, and a non-limited object of the present invention is to provide a lower-profile multi-band antenna.

According to one embodiment of the present invention, there is provided an antenna including: a linear first antenna portion; a conductive portion that connects the first antenna portion with a power feeding point; grounding regions where opposite ends of the first antenna portion are short-circuited and grounded; and a second antenna portion, at least a part of which overlaps with the conductive portion with a dielectric substance interposed between the conductive portion and the second antenna portion, wherein the second antenna portion is disposed in a region surrounded by the regions and the first antenna portion.

According to another embodiment of the present invention, there is provided an antenna including: a linear first antenna portion; a conductive portion that connects the first antenna portion with a power feeding point; grounding regions where opposite ends of the first antenna portion are short-circuited and grounded; and n−1 second antenna portions that are disposed in a region determined based on a relationship among the first antenna portion, the conductive portion, and the regions such that the second antenna portions resonate with the first antenna portion at n frequencies, where n represents 2 or more.

According to the present invention, a lower-profile multi-band antenna can be provided.

DETAILED DESCRIPTION OF THE EXEMPLARY EMBODIMENTS

Figure 1:
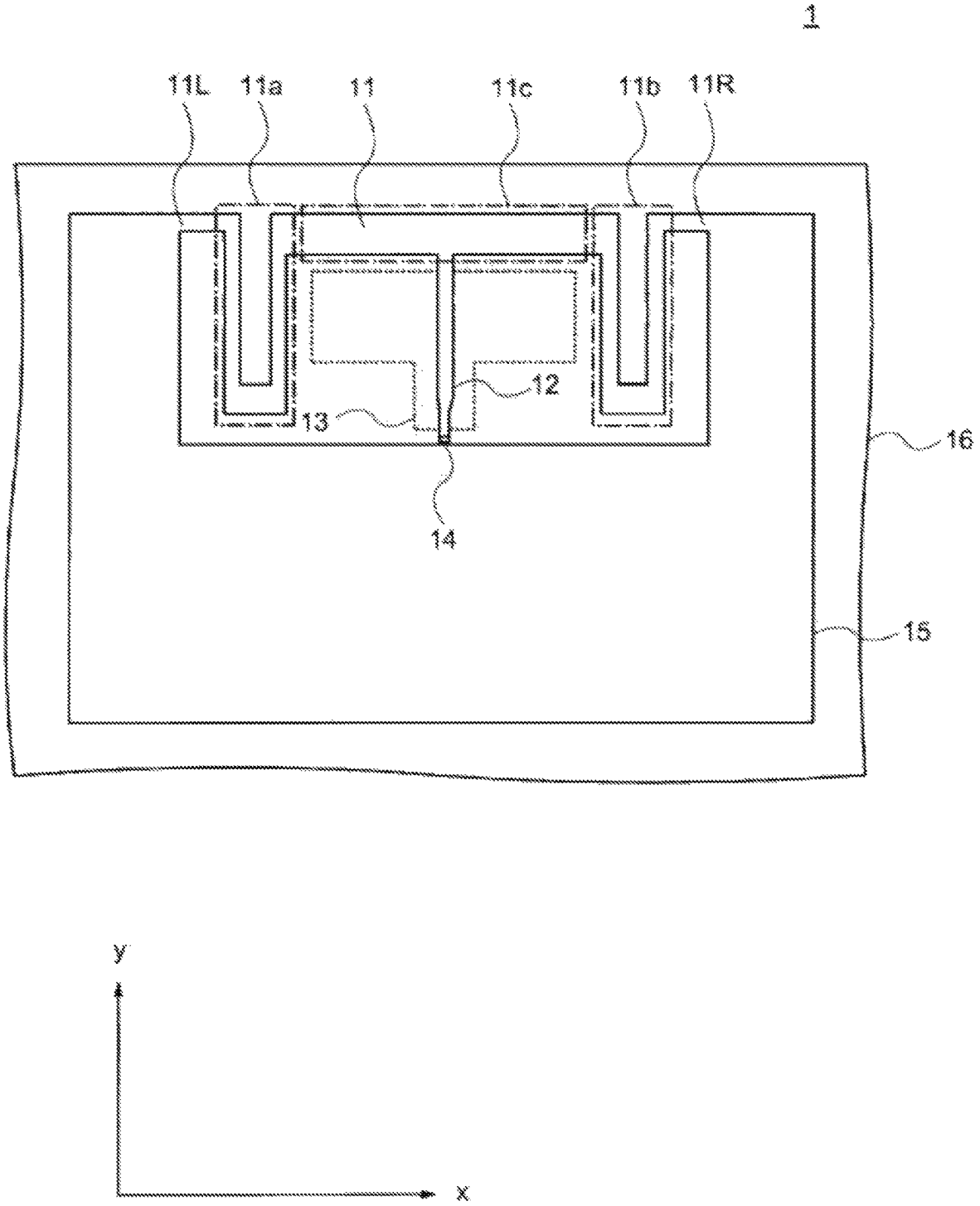
FIG. 1 is a diagram illustrating a configuration of an antenna according to one embodiment of the present invention.

Hereinafter, embodiments of the present invention will be described in detail with reference to the drawings. The following embodiments are exemplary embodiments of the present invention, but the present invention is not limited to the embodiments. In the drawings that are referred to as the embodiments, the same components or components having the same functions are represented by the same reference signs or similar reference signs (reference signs with A. B or the like added after numbers), and the description thereof will not be repeated. In addition, in the drawings, for the convenience of description, dimensional ratios (scale) may be different from actual ones, and a part of configurations may be omitted from the drawings.

First Embodiment

Figure 2:
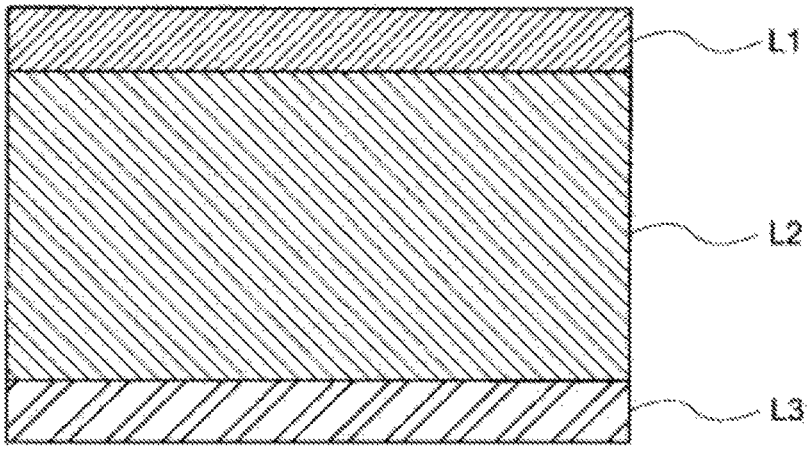
FIG. 2 is a diagram illustrating a configuration of a substrate layer of the antenna according to the embodiment of the present invention.

An antenna according to one embodiment of the present invention will be described using FIGS. 1 and 2. FIG. 1 is a diagram illustrating a configuration of the antenna according to the embodiment of the present invention. FIG. 2 is a diagram illustrating a configuration of the substrate layer of the antenna according to the embodiment of the present invention. The antenna 1 includes a first antenna portion 11, a conductive portion 12, a second antenna portion 13, a power feeding point 14, a ground 15, and a dielectric substrate 16. In this example, the substrate layer of the antenna has a three-layer structure including a first substrate layer L1, a second substrate layer L2, and a third substrate layer L3.

In this example, the first antenna portion 11 is a planar antenna that is formed on the dielectric substrate 16 by printing.

Figure 6:
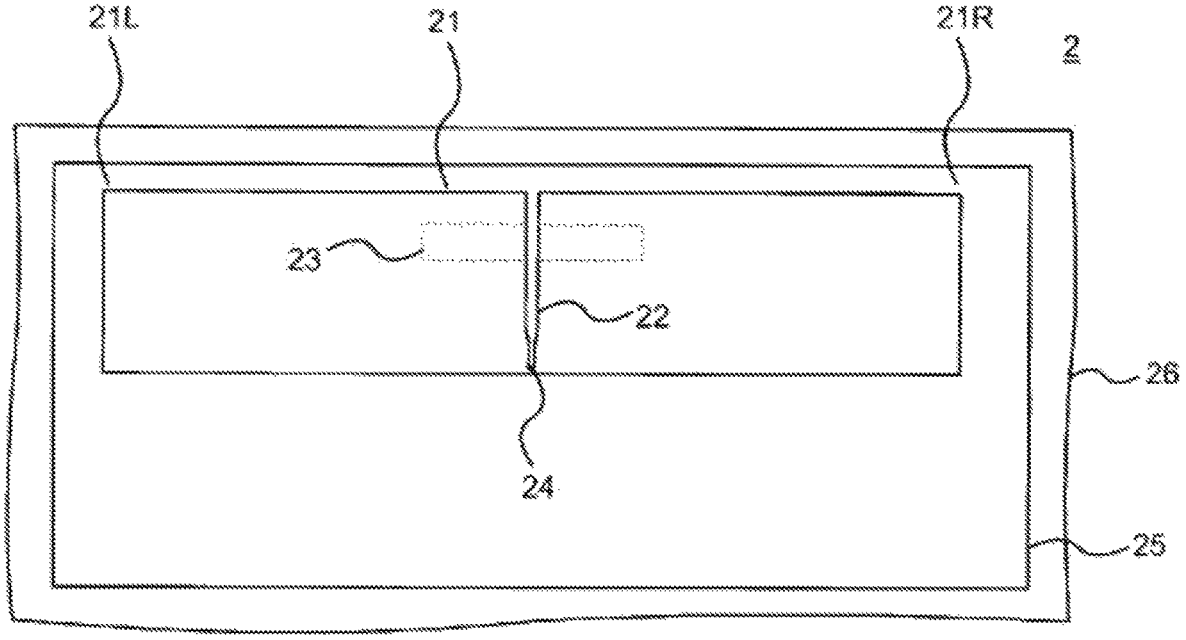
FIG. 6 is a diagram illustrating a configuration of an antenna according to another embodiment of the present invention.
Figure 8:
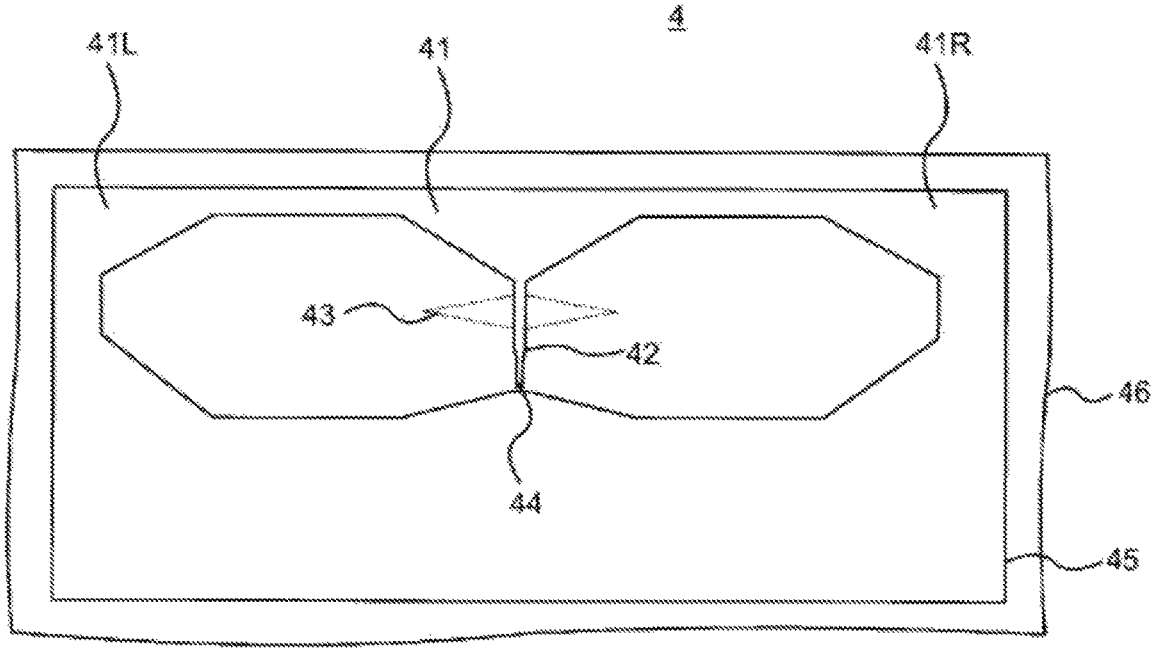
FIG. 8 is a diagram illustrating a configuration of an antenna according to still another embodiment of the present invention.

The shape of the first antenna portion 11 is linear. Here, "linear" represents not an elongated shape such as a line not having a width, but means a shape having a width. The width may be a width that is uniform at all the positions of the first antenna portion 21 as illustrated in FIG. 6, or may be a width that varies depending on positions as illustrated in FIG. 8. Reference sign 11L represents a left end portion of the first antenna portion 11, and reference sign 11R represents a right end portion of the first antenna portion 11. The left end portion and the right end portion will be referred together to as "opposite end portions". In this example, the first antenna portion 11 is disposed on the first substrate layer L1. In addition, in this example, the first antenna portion 11 includes antenna folded portions 11*a* and 11*b*. In addition, a straight line portion 11*c* of the first antenna portion 11 is connected to the antenna folded portions 11*a* and 11*b*. Here, a direction parallel to the straight line portion 11*c* of the first antenna portion 11 will be referred to as "x direction", and a direction perpendicular to the straight line portion lie of the first antenna portion 11 will be referred to as "y direction". The antenna folded portions 11*a* and 11*b* are formed to be long in the y direction and to be short in the x direction. As a result, the first antenna portion 11 can be formed to be short in the x direction.

In addition, the length of the first antenna portion 11 from the left end portion 11L to the right end portion 11R has a correlation with a resonance frequency. Therefore, in a case where the first antenna portion 11 includes the antenna folded portion, the size of the antenna can be further reduced as compared to a case where the antenna does not include the antenna folded portion.

The conductive portion 12 connects the first antenna portion 11 and the power feeding point 14 to each other. In this example, the conductive portion 12 is connected to the first antenna portion 11 at a middle point between the opposite ends of the first antenna portion 11. The position of the conductive portion 12 is not limited to the position where the conductive portion 12 is connected to the first antenna portion 11 at the middle point between the opposite ends of the first antenna portion 11. In addition, in this example, the conductive portion 12 is formed on the same layer as that on which the first antenna portion 11 is formed. Here, the second antenna portion 13 is a parasitic element. However, in order to generate a new resonance point using the parasitic element, it is necessary to dispose the second antenna portion 13 at a position affected by the conductive portion 12. Therefore, the conductive portion 12 may be at a position where at least a part thereof overlaps with the second antenna portion 13 with a dielectric substance interposed therebetween. However, in a case where the conductive portion 12 is connected to the first antenna portion 11 at a position shifted from the middle point between the opposite ends of the first antenna portion 11, a radiation pattern does not exhibit omnidirectionality. In the embodiment, the conductive portion 12 is connected to the first antenna portion 11 at the middle point between the opposite ends of the first antenna portion 11. In addition, in this example, in order to finely adjust the characteristic impedance of the antenna, an end portion of the conductive portion 12 connected to the power feeding point 14 is formed to be thin.

The ground 15 is formed in regions (grounding regions) where the opposite ends of the first antenna portion 11 are short-circuited and grounded. The first antenna portion 11 is connected to the ground 15 and operates in a loop. The opposite end portions of the first antenna portion 11 are connected to the left and right sides of the ground 15. Therefore, the current distribution is not spread all over the ground 15 but is concentrated on a region close to the first antenna portion 11.

The second antenna portion 13 is disposed such that at least a part thereof overlaps with the conductive portion 12 while interposing a dielectric substance (not illustrated) disposed as the second substrate layer L2 between the conductive portion 12 and the second antenna portion 13. In addition, the second antenna portion 13 is disposed in a region formed by the ground 15 and the first antenna portion 11, That is, the second antenna portion 13 does not overlap with the first antenna portion 11 and the ground 15 with the dielectric substance interposed therebetween. The second antenna portion 13 is disposed in a region determined based on a relationship between the first antenna portion 11, the conductive portion 12, and a region formed by the ground 15 and the first antenna portion 11 such that the second antenna portion 13 resonates with the first antenna portion 11 at plural frequencies. In addition, in this example, the second antenna portion 13 is disposed on the third substrate layer L3.

Unlike the first antenna portion 11, the second antenna portion 13 is not connected to the power feeding point and is a parasitic antenna element. In order to transmit radio waves from the second antenna portion 13, it is necessary that a high-frequency current flows in the second antenna portion 13 due to an effect of the conductive portion 12. Therefore, it is necessary that the second antenna portion 13 is disposed at a position at some distance from the conductive portion 12. On the other hand, in a case where the second antenna portion 13 is excessively close to the conductive portion 12, VSWR (voltage standing wave ratio) frequency characteristics deteriorate.

Figure 3A:
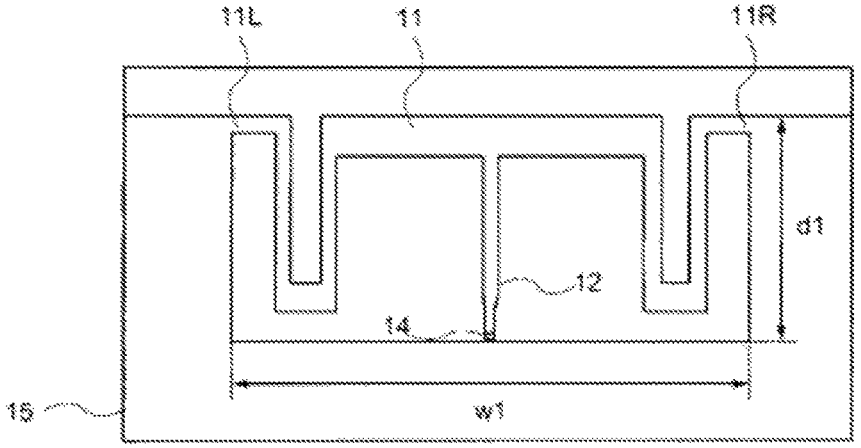
FIG. 3A is a diagram illustrating a state of a simulation for verifying VSWR frequency characteristics and a radiation pattern of the antenna according to the embodiment of the present invention.
Figure 3B:
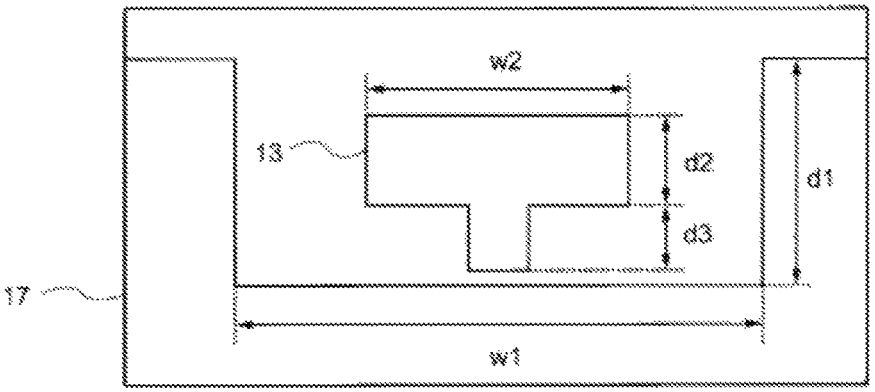
FIG. 3B is a diagram illustrating a state of the simulation for verifying VSWR frequency characteristics and a radiation pattern of the antenna according to the embodiment of the present invention.
Figure 4:
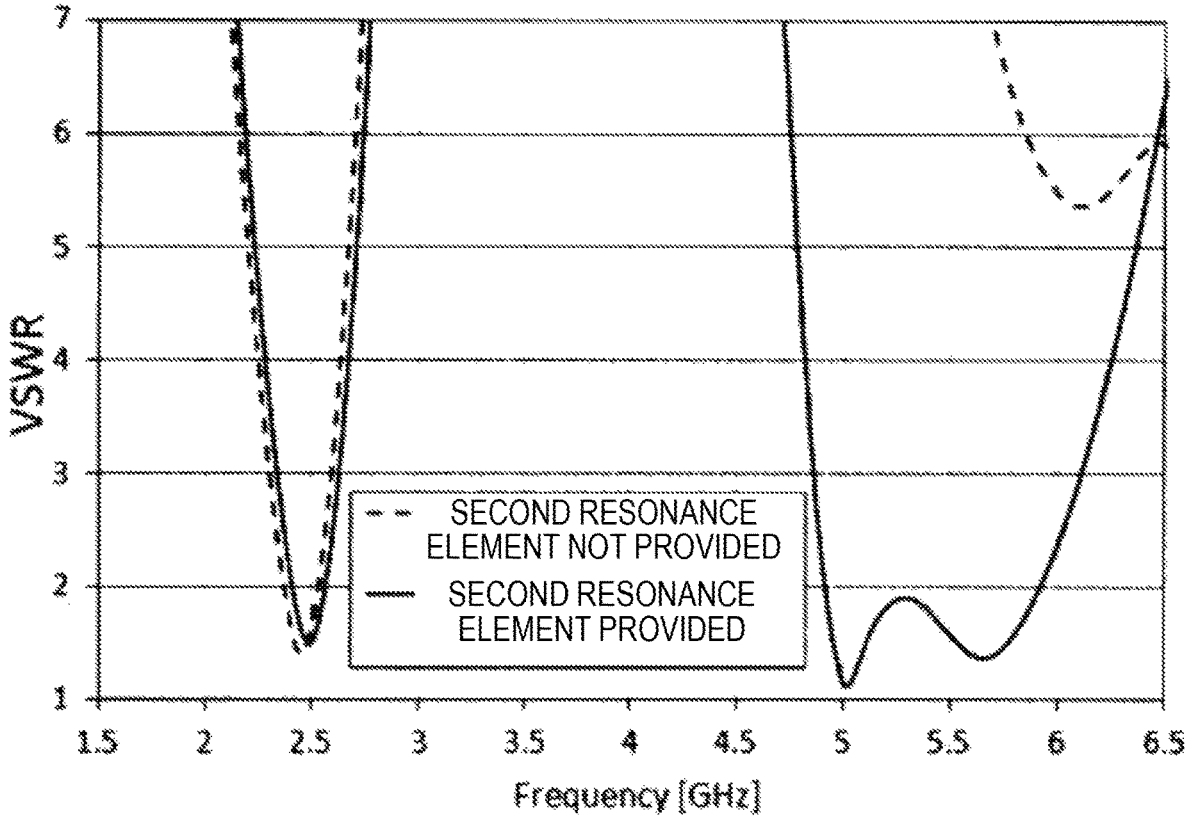
FIG. 4 is a graph illustrating a simulation result that shows the VSWR frequency characteristics of the antenna according to the embodiment of the present invention.

In order to obtain a range of a distance between a plane where the second antenna portion 13 is formed and a plane where the conductive portion 12 is formed, the distance between the plane where the second antenna portion 13 is formed and the plane where the conductive portion 12 is formed was moved in an antenna shape illustrated in FIGS. 3A and 3B. When this distance was moved, whether or not the adjustment of characteristic impedance is achieved in the vicinity of 2.5 GHz and in the vicinity of 5 GHz as illustrated in FIG. 4 is verified to obtain a range where the adjustment is achieved.

With the antenna shape illustrated in FIGS. 3A and 3B, under the conditions of w1=35 mm, d1=14 mm, w2=16 mm, d2=6.5 mm, and d3=3 mm, when the distance between the plane where the second antenna portion 13 is formed and the plane where the conductive portion 12 is formed is λ/250 with respect to a resonance frequency of the first antenna, a simulation for verifying the VSWR frequency characteristics of the antenna was performed. As a result, the simulation result illustrated in FIG. 4 was obtained, and it was verified that the adjustment of characteristic impedance is achieved in the vicinity of 2.5 GHZ and in the vicinity of 5 GHz.

On the other hand, with the antenna shape illustrated in FIGS. 3A and 3B, under the conditions of w1=35 mm, d1=14 mm, w2=14 mm, d2=6.5 mm, and d3=4 mm, when the distance between the plane where the second antenna portion 13 is formed and the plane where the conductive portion 12 is formed is λ/25 with respect to the resonance frequency of the first antenna, a simulation for verifying the VSWR frequency characteristics of the antenna was performed. As a result, the simulation result illustrated in FIG. 4 was obtained, and it is verified that the adjustment of characteristic impedance is achieved in the vicinity of 2.5 GHZ and in the vicinity of 5 GHz.

Therefore, it is preferable that the distance between the plane where the second antenna portion 13 is formed and the plane where the conductive portion 12 is formed is λ/250 to λ/25, inclusive, with respect to the resonance frequency of the first antenna.

In this example, the second antenna portion 13 has a T-shape for optimizing the impedance. Of course, the shape of the second antenna portion 13 is not limited to the example and may be a rectangular shape or the like as long as two desired frequencies can be transmitted and received in combination with the first antenna portion 11.

As illustrated in FIG. 2, the substrate layer of the antenna has a three-layer structure including the first substrate layer L1, the second substrate layer L2, and the third substrate layer L3. The first substrate layer L1 includes the first antenna portion 11 and the ground 15. The second substrate layer L2 includes the dielectric substance. In this example, a material of the dielectric substance of the second substrate layer L2 is Glass Epoxy FR4 and has a dielectric constant εr of 4.7 and a thickness of 0.6 mm. Of course, the material of the dielectric substance of the second substrate layer L2 is not limited to Glass Epoxy FR4 and may be a Teflon (registered trade mark) substrate or the like. In addition, the dielectric substance of the second substrate layer may be air. In the case of air, a space is provided between the first substrate layer L1 and the third substrate layer L3. In a case where the dielectric constant is high, the wavelength is shortened, and the thickness of the second substrate layer L2 is also reduced. Glass Epoxy FR4 has a higher dielectric constant than air. Therefore, in a case where the dielectric substance is Glass Epoxy FR4, an effect of reducing the thickness of the second substrate layer L2 is exhibited more clearly than in a case where the dielectric substance is air.

The third substrate layer L3 includes the second antenna portion 13 and a ground (not illustrated). In this example, the ground has the same shape and size as the ground 15 of the first substrate layer L1 as illustrated in a ground 17 of FIG. 3B. Of course, the ground 17 may not be provided.

<Simulation Conditions>

FIGS. 3A and 3B are diagrams illustrating states of a simulation for verifying VSWR frequency characteristics and radiation patterns of the antenna according to the embodiment of the present invention.

In this simulation, the substrate layer of the antenna is formed with three layers. FIG. 3A is a diagram illustrating the substrate layer when seen from the first substrate layer L1 side. On the first substrate layer L1, the first antenna portion 11, the conductive portion 12, the power feeding point 14, and the ground 15 are disposed. On the second substrate layer L2, the dielectric substance is disposed. FIG. 3B is a diagram illustrating the substrate layer when seen from the third substrate layer L3 side. On the third substrate layer L3 the second antenna portion 13 and the ground 17 are disposed.

As illustrated in FIGS. 3A and 3B, the length w1 between the opposite end portions of the first antenna portion 11 is 35 mm, and the vertical length d1 of the ground 15 is 14 mm. In addition, the second antenna portion 13 has a T-shape and has dimensions of w2=17.5 mm, d2=5 mm, and d3=4 mm. The thickness of the second substrate layer L2 of the antenna is 0.6 mm.

The dielectric substance of the second substrate layer L2 is Glass Epoxy FR4 and has a dielectric constant εr of 4.7 and a thickness of 0.6 mm.

<Simulation Result>

Figure 5A:
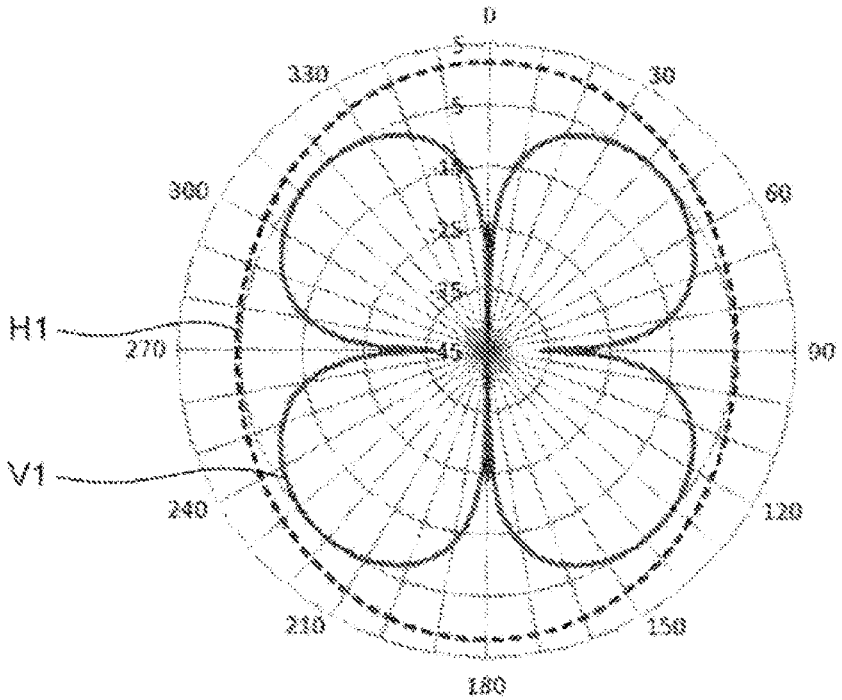
FIG. 5A is a simulation result for verifying the radiation pattern of the antenna according to the embodiment of the present invention.
Figure 5B:
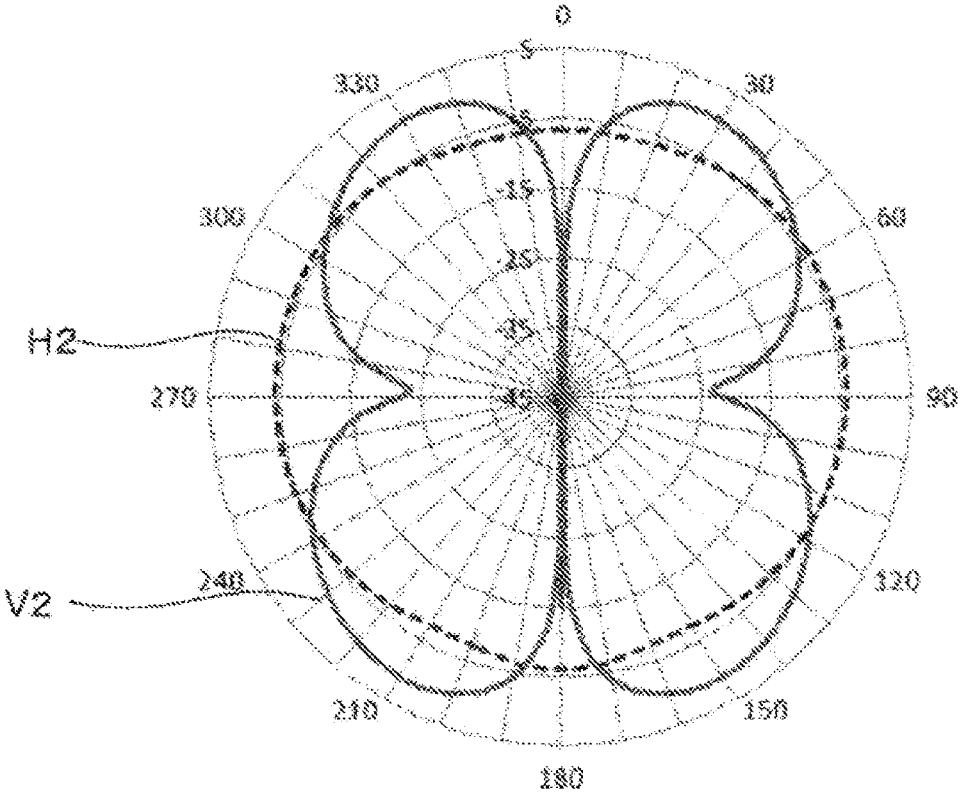
FIG. 5B is a simulation result for verifying the radiation pattern of the antenna according to the embodiment of the present invention.

FIG. 4 is a simulation result that shows the VSWR frequency characteristics of the antenna according to the embodiment of the present invention. FIGS. 5A and 5B are simulation results for verifying the radiation pattern of the antenna according to the embodiment of the present invention.

A broken line of FIG. 4 indicates VSWR in a case where the first antenna portion 11 is provided but the second antenna portion (second resonance element) 13 is not provided. A solid line of FIG. 4 indicates VSWR in a case where not only the first antenna portion 11 but also the second antenna portion (second resonance element) 13 are provided.

In a case where the first antenna portion 11 is provided but the second antenna portion 13 is not provided as indicated by the broken line of FIG. 4, a value of VSWR in the vicinity of 2.5 GHz is close to 1, whereas a value of VSWR in the vicinity of 5 to 6 GHz is distant from 1.

On the other hand, in a case where not only the first antenna portion 11 but also the second antenna portion 13 are provided, as indicated by the solid line of FIG. 4, a value of VSWR in the vicinity of 2.5 GHz and a value of VSWR in the vicinity of 5 GHz are close to 1, and it can be seen that the efficiency of the antenna radiating electric energy is the highest in the vicinity of 2.5 GHz and in the vicinity of 5 GHz. That is, in the vicinity of 2.5 GHz and in the vicinity of 5 GHz, the adjustment of characteristic impedance is achieved.

It can be seen from the solid line and the broken line of FIG. 4 that a new resonance point is generated in the 5 to 6 GHz band by adding the second antenna portion 13. In addition, it can be said that the antenna, which had become the simulation target, is a dual band antenna that functions as an antenna in two frequency bands in the vicinity of 2.5 GHz and in the vicinity of 5 GHz although the thickness of the second substrate layer L2 of the antenna is 0.6 mm.

FIG. 5A is a diagram illustrating a radiation pattern (2.4 GHz band) obtained by the first antenna portion 11. FIG. 5B is a diagram illustrating a radiation pattern (5 GHz band) at the resonance point that is generated by adding second antenna portion 13 to the first antenna portion 11.

H1 (broken line) of FIG. 5A indicates the gain of horizontally polarized waves, and V1 (solid line) of FIG. 5A indicates the gain of vertically polarized waves. In addition, H2 (broken line) of FIG. 5B indicates the gain of horizontally polarized waves, and V2 (solid line) of FIG. 5B indicates the gain of vertically polarized waves. Further, a value of the gain refers to a value (dBi) obtained with an isotropic antenna as a reference.

As indicated by H1 of FIG. 5A and H2 of FIG. 5B, it can be seen that a substantially omnidirectional radiation pattern is obtained and the maximum gain is about 2 dBi and thus excellent characteristics are exhibited.

In the related art, the antenna is configured by the radiation conductor that is disposed on the ground and the element that is disposed adjacent to the radiation conductor and is short-circuited to the parasitic ground, and thus there is a limit on reduction in size. Contrarily, in the embodiment, the first antenna portion 11 can be formed in the same planar shape as that of the ground 15. Therefore, the thickness of the second substrate layer L2 of the substrate layer of the antenna can be reduced. Specifically, even in a case where the thickness of the second substrate layer L2 of the substrate layer of the antenna is $\lambda/200$, the antenna functions as a multi-band antenna (dual band antenna). Accordingly, an advantageous effect is exhibited that a lower-profile multi-band antenna (dual band antenna) can be provided as compared to the related art.

In addition, in the related art, the radiation conductor is provided, and the element that is short-circuited to the parasitic ground is disposed on the same horizontal plane as the radiation conductor. Therefore, there is a problem that offset occurs in a radiation pattern. Contrarily, in the embodiment, as indicated by H1 of FIG. 5A and H2 of FIG. 5B, an effect of suppressing offset in the radiation pattern is exhibited.

Further, in the related art, the element that is short-circuited to the ground is used. The antenna has a problem that ground dependence is high and that characteristics thereof largely vary depending on the shape of the provided ground. Contrarily, in the embodiment, the first antenna portion 11 is connected to the ground 15 and operates in a loop. Therefore, an effect is exhibited that the antenna has low ground dependence and obtains an excellent radiation pattern.

In addition, in the embodiment, the first antenna portion 11 includes the antenna folded portions on its left and right sides. In this case, an effect can be exhibited that the width of the first antenna portion 11 can be reduced, and that saving space can be realized.

Second Embodiment

An antenna according to another embodiment of the present invention will be described using FIG. 6. FIG. 6 is a diagram illustrating a configuration of the antenna according to another embodiment of the present invention. The antenna 2 has substantially the same configuration as the antenna 1 according to the first embodiment. Therefore, different points from those of the first embodiment will be described without describing the same points.

The antenna 2 includes a first antenna portion 21, a conductive portion 22, a second antenna portion 23, a power feeding point 24, a ground 25, and a dielectric substrate 26. In the embodiment, the first antenna portion 21 does not include an antenna folded portion. Since the antenna folded portion is not provided, the width of the first antenna portion 21 is longer than the width of the antenna folded portion 11 according to the first embodiment.

In this example, the second antenna portion 23 has a rectangular shape. The width of the second antenna portion 23 is longer than the width w2 of the second antenna portion 13 according to the first embodiment. Since the first antenna portion 21 does not include the antenna folded portion, the second antenna portion 23 can be configured such that the width of second antenna portion 23 is longer than the width of second antenna portion 13 according to the first embodiment. Of course, the shape of the second antenna portion 23 is not limited to a rectangular shape, and may be a T-shape as in the second antenna portion 13 according to the first embodiment and may be any shape as long as the second antenna portion 23 can resonate at two desired frequencies.

In the embodiment, the same effects as those of the first embodiment are also exhibited.

In the embodiment, since the first antenna portion 21 does not include the antenna folded portion, the second antenna portion 23 can be configured such that the width of second antenna portion 23 is longer than the width of second antenna portion 13 according to the first embodiment. Accordingly, an effect that the shape of the second antenna portion 23 can be more flexibly determined is exhibited.

Third Embodiment

Figure 7:
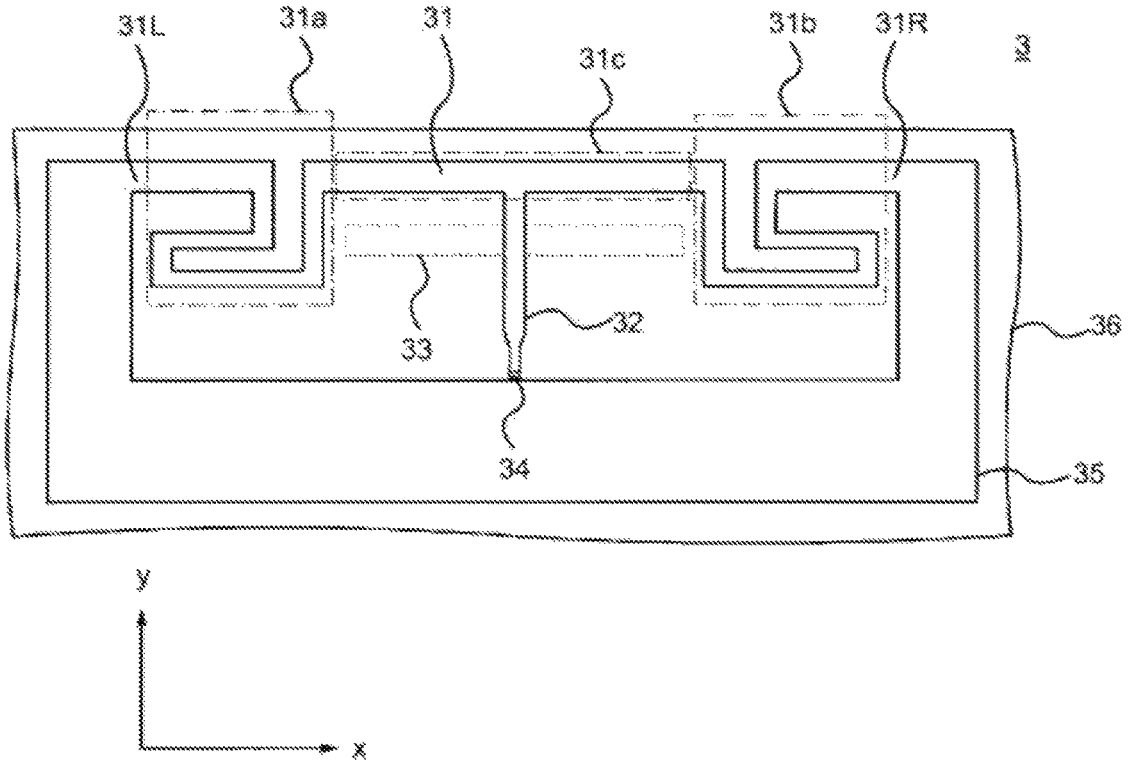
FIG. 7 is a diagram illustrating a configuration of an antenna according to still another embodiment of the present invention.

An antenna according to still another embodiment of the present invention will be described using FIG. 7. FIG. 7 is a diagram illustrating a configuration of the antenna according to the still another embodiment of the present invention. The antenna 3 has substantially the same configuration as the antenna 1 according to the first embodiment. Therefore, different points from those of the first embodiment will be described without describing the same points.

The antenna 3 includes a first antenna portion 31, a conductive portion 32, a second antenna portion 33, a power feeding point 34, a ground 35, and a dielectric substrate 36. In the embodiment, antenna folded portions 31*a* and 31*b* are provided in a same shape as the first antenna portion 11, but a folding method of the antenna is different. In addition, a straight line portion 31*c* of the first antenna portion 31 is connected to the antenna folded portions 31*a* and 31*b*. Here, a direction parallel to the straight line portion 31*c* of the first antenna portion 31 will be referred to as "x direction", and a direction perpendicular to the straight line portion 31*c* of the first antenna portion 31 will be referred to as "y direction". In the embodiment, the first antenna portion 31 is folded such that a portion parallel to the straight line portion 31*c* of the first antenna portion 31 is longer than that of the first embodiment. That is, the antenna folded portions 31*a* and 31*b* are formed to be longer in the x direction and to be shorter in the y direction than those of the first embodiment. Of course, the folding method of the antenna is not limited to these, and any folding method may be adopted as long as desired frequencies can be transmitted and received.

In the embodiment, the same effects as those of the second embodiment are also exhibited.

Fourth Embodiment

An antenna according to still another embodiment of the present invention will be described using FIG. 8. FIG. 8 is a diagram illustrating a configuration of the antenna according to the still another embodiment of the present invention. The antenna 4 has substantially the same configuration as the antenna 1 according to the first embodiment. The fourth embodiment is different from the first embodiment in the shapes of the first antenna portion 41 and the second antenna portion 43. Therefore, different points from those of the first embodiment will be described without describing the same points.

The antenna 4 includes a first antenna portion 41, a conductive portion 42, a second antenna portion 43, a power feeding point 44, a ground 45, and a dielectric substrate 46. The shape of the first antenna portion 41 is a polygonal shape. In addition, the shape of the second antenna portion 43 is a rhombic shape. The shape of the second antenna portion 43 is not limited to this and may be a polygonal shape such as a hexagonal shape.

In the embodiment, the same effects as those of the second embodiment and the third embodiment are also exhibited.

Fifth Embodiment

Figure 9:
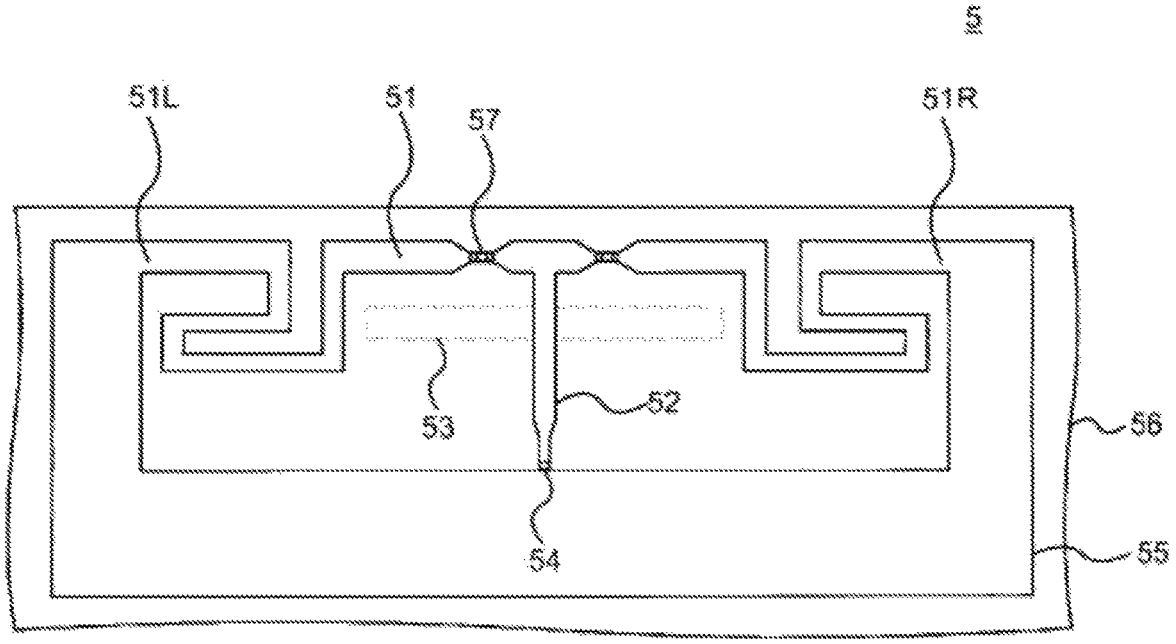
FIG. 9 is a diagram illustrating a configuration of an antenna according to still another embodiment of the present invention.

An antenna according to still another embodiment of the present invention will be described using FIG. 9, FIG. 9 is a diagram illustrating a configuration of the antenna according to the still another embodiment of the present invention. The antenna 5 has substantially the same configuration as the antenna 3 according to the third embodiment. Therefore, different points from those of the third embodiment will be described without describing the same points.

The antenna 5 includes a first antenna portion 51, a conductive portion 52, a second antenna portion 53, a power feeding point 54, a ground 55, a dielectric substrate 56, and a chip capacitor 57.

In the embodiment, the chip capacitor 57 may be inserted into the first antenna portion 51. As a result, the chip capacitor 57 can be used in place of capacitance included in the first antenna portion 11 according to the first embodiment.

In the embodiment, the same effects as those of the second to fourth embodiments are also exhibited.

Sixth Embodiment

Figure 10A:
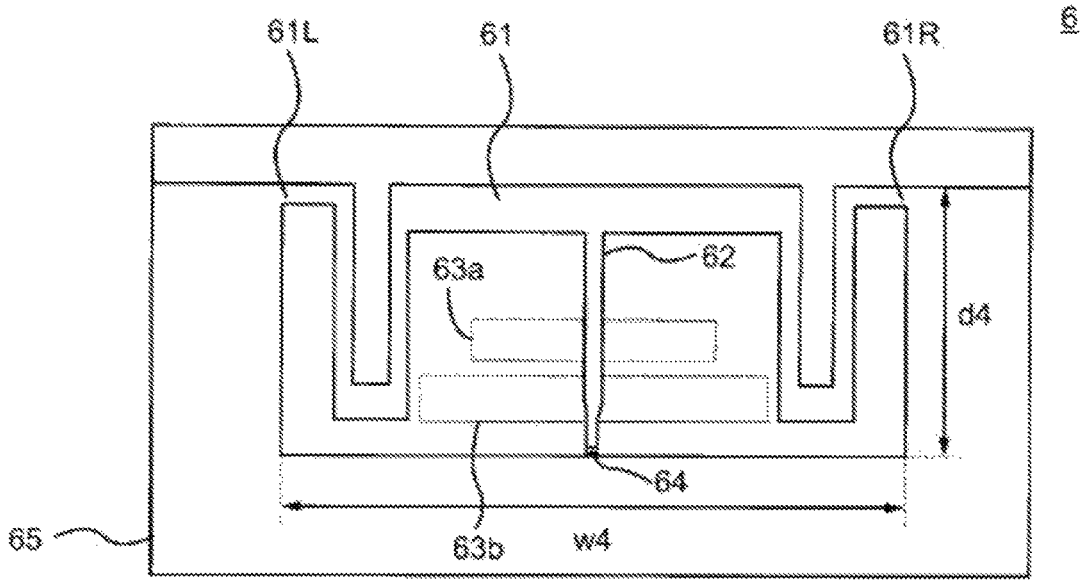
FIG. 10A is a diagram illustrating a configuration of an antenna according to still another embodiment of the present invention.
Figure 10B:
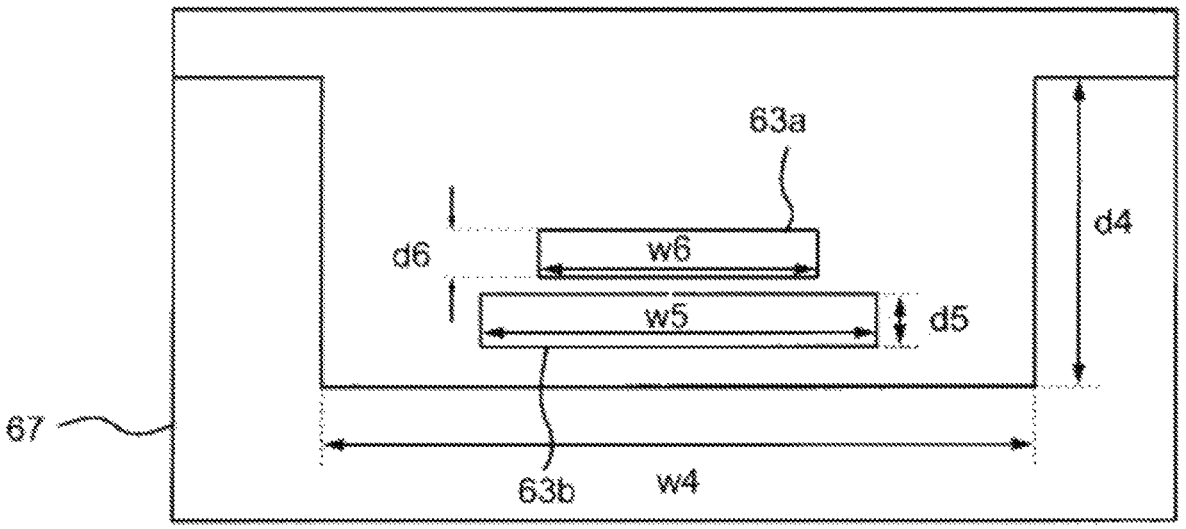
FIG. 10B is a diagram illustrating a state of a simulation for verifying VSWR frequency characteristics of the antenna according to the still another embodiment of the present invention.

The first to fifth embodiments have been described assuming that the antenna is a dual band antenna. An antenna according to still another embodiment of the present invention will be described using FIGS. 10A and 10B. FIG. 10A is a diagram illustrating a configuration of the antenna according to the still another embodiment of the present invention. FIG. 10B is a diagram illustrating the state of the simulation for verifying VSWR frequency characteristics of the antenna according to the still another embodiment of the present invention. The antenna 6 has substantially the same configuration as the antenna 1 according to the first embodiment. The sixth embodiment is different from the first embodiment in that the antenna resonates at three frequencies. Therefore, different points from those of the first embodiment will be described without describing the same points.

The antenna 6 includes a first antenna portion 61, a conductive portion 62, a power feeding point 64, a ground 65, and a dielectric substrate 66. In addition, the antenna 6 includes two second antenna portions 63*a* and 63*b* that are disposed in a region determined based on a relationship between the first antenna portion 61, the conductive portion 62, and regions where opposite ends of the first antenna portion 61 are short-circuited and grounded. In other words, the second antenna portion 63*a* and the second antenna portion 63*b* are disposed in a region that is formed by the ground 65 and the first antenna portion 61.

Conditions of a simulation for verifying VSWR frequency characteristics of the antenna 6 are as follows. That is, a substrate layer of the antenna has a three-layer structure as in the first embodiment. In the sixth embodiment, unlike the first embodiment, the second antenna portion 63*a* and the second antenna portion 63*b* are disposed on the third substrate layer L3.

In addition, in FIGS. 10A and 10B, d4=14 mm, w1=51 mm, d5=3 mm, w5=36 mm, d6=4 mm, and w6=24 mm. The distance between a plane where the second antenna portions 63*a* and 63*b* are formed and a plane where the conductive portion 62 is formed is 1.6 mm.

Figure 11:
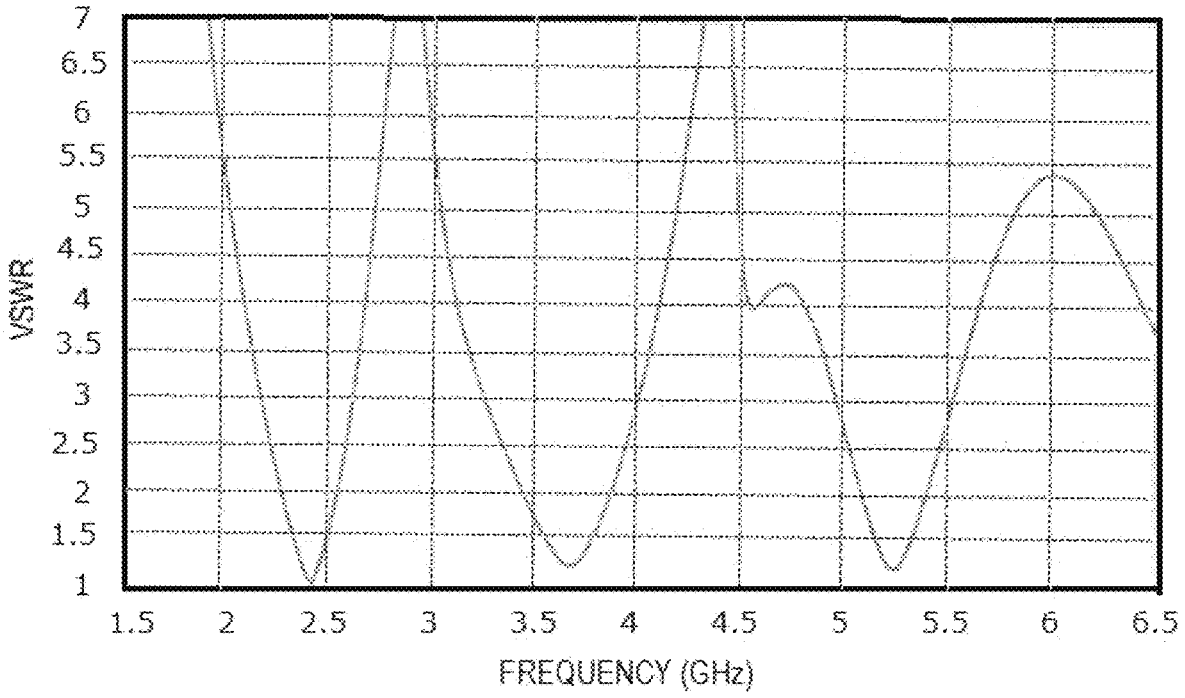
FIG. 11 is a graph illustrating a simulation result that shows the VSWR frequency characteristics of the antenna according to the embodiment of the present invention.

When the simulation was performed under the above-described simulation conditions, the result illustrated in FIG. 11 was obtained. FIG. 11 is the simulation result that shows the VSWR frequency characteristics of the antenna according to the embodiment of the present invention.

As indicated by a solid line of FIG. 11, it can be seen that in a case where not only the first antenna portion 61 but also the second antenna portion 63*a* and the second antenna portion 63*b* are provided, a value of VSWR in the vicinity of 2.4 GHz, a value of VSWR in the vicinity of 3.7 GHz, and a value of VSWR in the vicinity of 5.25 GHz are close to 1, and that the efficiency of the antenna radiating electric energy is the highest in the vicinity of 2.4 GHz, in the vicinity of 3.7 GHz, and in the vicinity of 5.25 GHz. That is, at three resonance frequencies in the vicinity of 2.4 GHz, in the vicinity of 3.7 GHz, and in the vicinity of 5.25 GHz, the adjustment of characteristic impedance is achieved.

Of course, the number of second antenna portions is not limited to two n−1) second antenna portions may be provided such that the second antenna portions resonate with the first antenna portion 61 at n frequencies. Additionally, the (n−1) second antenna portions are disposed in a region determined based on the relationship between the first antenna portion 61, the conductive portion 62, and regions where the opposite ends of the first antenna portion 61 are short-circuited and grounded.

In the embodiment, the same effects as those of the first embodiment are also exhibited.

Modification Example 1

Figure 12:
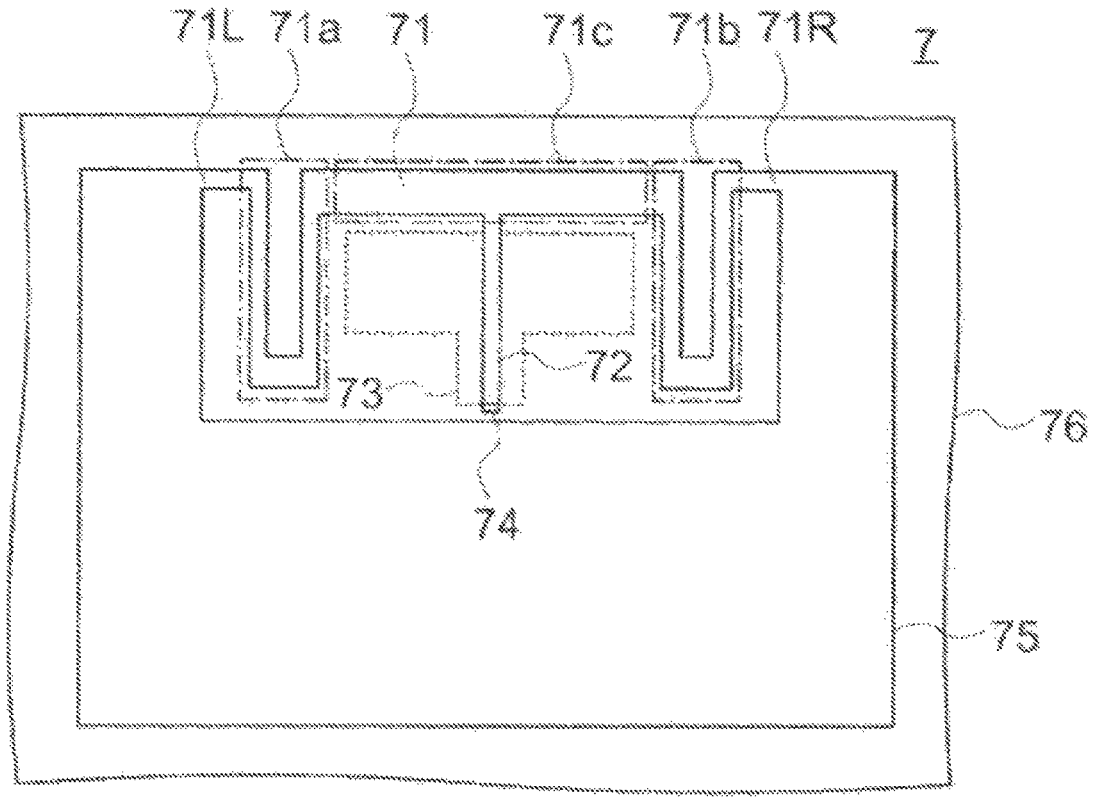
FIG. 12 is a diagram illustrating a configuration of an antenna according to a modification example of the present invention.

The first to sixth embodiments have been described assuming that an end portion of the conductive portion connected to the power feeding point is thin. Of course, in any one of the first to sixth embodiments, the end portion of the conductive portion is not necessarily thin. For example, an antenna 7 illustrated in FIG. 12 and the antenna 1 according to the first embodiment differ from each other in the conductive portion. That is, an end portion of the conductive portion 72 is not thin unlike the conductive portion 12.

In this modification example, the same effects as those of the first embodiment are also exhibited.

Modification Example 2

The first to sixth embodiments and the modification example 1 have been described assuming that the substrate layer of the antenna has a three-layer structure. However, in any one of the embodiments and the modification example 1, the substrate layer of the antenna is not limited to the three-layer structure and may have a multi-layer structure other than the three-layer structure. For example, whereas in the first embodiment, the first antenna portion 11 and the ground 15 are disposed on the first substrate layer L1 of the substrate layer of the antenna, in a case where the substrate layer of the antenna has a multi-layer structure including three or more layers, the first antenna portion may be disposed on the first substrate layer, and the ground may be disposed on the second substrate layer. In this case, if a through hole is provided in the first substrate layer and the opposite ends of the first antenna portion are electrically connected to the ground, the same effects as those of the first embodiment can be obtained.

Regarding the antenna according to any one of the first to sixth embodiments and the modification example 1, in a case where the substrate layer of the antenna has a multi-layer structure including three or more layers, an effect of increasing the degree of freedom for the design of a wiring or the like is exhibited.

The above-described antenna is applicable to an access point or the like of a wireless LAN and can be mounted on an application product in which a multiband is used.

The conductive portion may be connected to the first antenna portion at a middle point between the opposite ends of the first antenna portion.

The first antenna portion and the conductive portion may be formed on the same layer.

A capacitor may be inserted into the first antenna portion.

As described above, the second antenna portion 13 has a T-shape. The T-shape is not limited to a shape in which two rectangles are combined, but may be a shape in which two ellipses are combined. Each side of the rectangles that form the T-shape may be curved to some extent.

Figure 13:
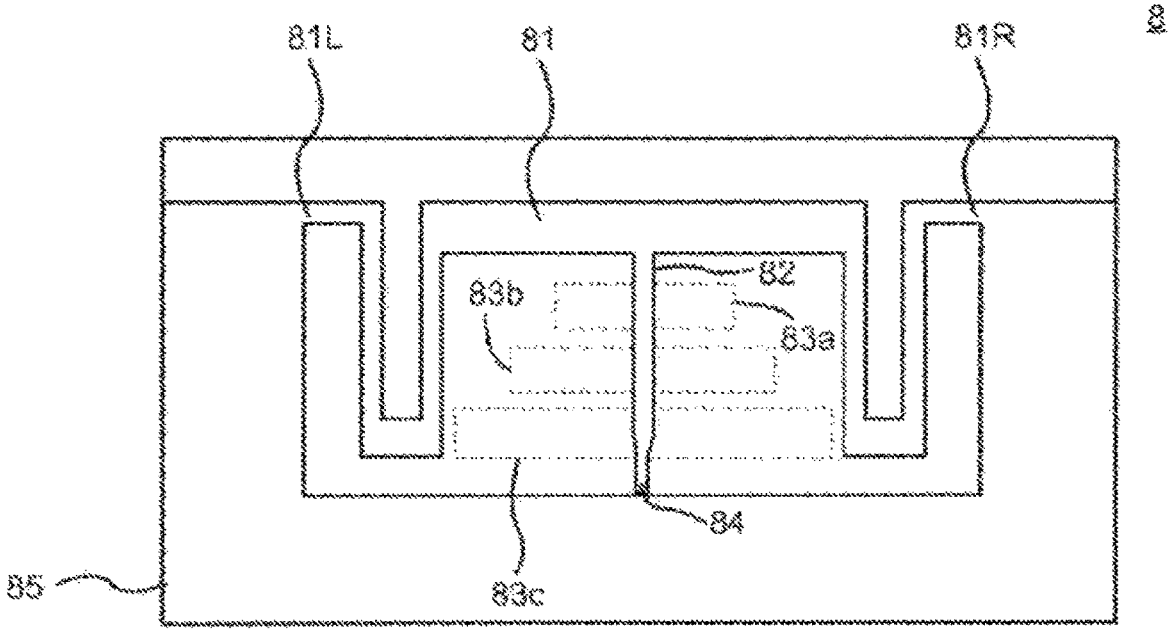
FIG. 13 is a diagram illustrating a configuration of an antenna according to a modification example of the present invention.

In addition, in the sixth embodiment, the case where a plurality of second antenna portions are provided has been described. That is, in the examples illustrated in FIGS. 10A, 10B, and 11, the number of second antenna portions is two. However, as described above, the number of second antenna portions may be appropriately changed and designed according to resonance frequencies. For example, as illustrated in FIG. 13, three second antenna portions 83*a* to 83*c* may be provided such that the second antenna portions resonate with a first antenna portion 81 at four frequencies. The width of the second antenna portion 83*c* is longer than the width of the second antenna portion 83*b*. Likewise, the width of the second antenna portion 83*b* is longer than the width of the second antenna portion 83*a*. The second antenna portions 83*a* to 83*c* are disposed in a region determined based on a relationship between the first antenna portion 81, the conductive portion 82, and regions where opposite ends of the first antenna portion 81 are short-circuited and grounded. In this example, the second antenna portion 81*a* whose width is short, the second antenna portion 83*b*, and the second antenna portion 83*c* are disposed in that order from the first antenna portion 81 side. However, the disposition order is not limited to this example. For example, the second antenna portion 83*c* having the longest width may be disposed on the first antenna portion 81 side, or the second antenna portion 83*c* may be disposed in the middle among the three second antenna portions.

The present invention is not limited to the embodiments, and appropriate changes can be made thereto within the scope not departing from the spirit.

Reference signs used in the specification and drawings are listed as below.

1, 2, 3, 4, 5, 6, 7: Antenna

11, 21, 31, 41, 51, 61, 71: First antenna portion

11L, 21L 31L, 41L, 51L, 61L, 71L: Left end portion of first antenna portion

11R, 21R, 31R, 41R, 51R, 61R, 71R: Right end portion of first antenna portion

12, 22, 32, 42, 52, 62, 72: Conductive portion

13, 23, 33, 43, 53, 63*a*, 63*b*, 73: Second antenna portion

14, 24, 34, 44, 54, 64, 74: Power feeding point

15, 17, 25, 35, 45, 55, 65, 67: Ground

16, 26, 36, 46, 56, 76: Dielectric substrate

What is claimed is:

1. A multi-band antenna comprising:

a linear antenna element including folded portions;

a conductive element connected to the linear antenna element at a middle point between opposite ends of the linear antenna element and including a power feeding point;

a ground element including grounding regions at which the opposite ends of the linear antenna element are electrically short circuited;

a T-shaped antenna element, with at least a part thereof structurally overlapping the conductive element;

a dielectric substrate interposed between the conductive element and the T-shaped antenna element, wherein an entirety of the T-shaped antenna element is symmetrically disposed in a region surrounded by the ground element and the linear antenna element, and wherein the linear antenna element and the conductive element are formed on a same layer of the dielectric substrate.

2. The multi-band antenna according to claim 1, wherein a capacitor is inserted into the linear antenna element.

3. The multi-band antenna according to claim 1, wherein a distance between a surface where the conductive element is formed and another surface where the T shaped antenna element is formed is $\lambda/250$ to $\lambda/25$, inclusive, with respect to a resonance frequency of the linear antenna element.

4. The multi-band antenna according to claim 1, wherein a chip capacitor is inserted into the linear antenna element.

5. A planar antenna comprising:

a linear first antenna element including multiple turns;

a T-shaped conductive feed element connected to the linear first antenna element at a middle point between opposite ends of the linear first antenna element;

a ground element including grounding regions at which the opposite ends of the linear first antenna element are electrically short circuited and grounded;

a linear second antenna element, with at least a part thereof structurally overlapping the T-shaped conductive feed element;

chip capacitors inserted between the linear first antenna element and the T-shaped conductive feed element;

a dielectric substrate interposed between the T-shaped conductive feed element and the linear second antenna element, wherein an entirety of the linear second antenna element is symmetrically disposed in a region surrounded by the ground element and the linear first antenna element.

* * * * *